US006644160B1

(12) United States Patent
Boselli

(10) Patent No.: US 6,644,160 B1
(45) Date of Patent: Nov. 11, 2003

(54) VERTICAL BLIND CUTTING AND HOLE-PUNCHING APPARATUS

(76) Inventor: William C. Boselli, 12207 Vista Del Cajon Rd., El Cajon, CA (US) 92021

( * ) Notice: Subject to any disclaimer, the term of this patent is extended or adjusted under 35 U.S.C. 154(b) by 148 days.

(21) Appl. No.: 09/833,473

(22) Filed: Apr. 12, 2001

(51) Int. Cl.[7] ..... B26D 9/00

(52) U.S. Cl. ..... 83/518; 83/607; 83/651; 83/682; 29/24.5; 248/688

(58) Field of Search ..... 83/607, 446, 448, 83/518, 25, 268, 633, 681, 613, 682, 449, 929.1, 583, 35, 477.2, 473, 588, 582, 651, 40, 56, 197, 213, 249, 256, 405, 519, 564, 581, 684, 694; 29/24.5; 271/240, 253, 254; 220/629; 248/688

(56) References Cited

U.S. PATENT DOCUMENTS

| | | | | | |
|---|---|---|---|---|---|
| 17,996 | A | * | 8/1857 | Hooper | 83/518 |
| 43,458 | A | * | 7/1864 | Moseley | 83/518 |
| 133,567 | A | * | 12/1872 | Corry | 83/583 |
| 189,524 | A | * | 4/1877 | Tobin | 83/518 |
| 250,575 | A | * | 12/1881 | Rafelson | 83/518 |
| 362,468 | A | * | 5/1887 | Stortz | 83/518 |
| 365,517 | A | * | 6/1887 | Hazen | 83/518 |
| 377,264 | A | * | 1/1888 | McDonald | 83/518 |
| 484,369 | A | * | 10/1892 | Horner | 83/682 |
| 855,765 | A | * | 6/1907 | Gerlach | 83/518 |
| 1,470,492 | A | * | 10/1923 | Shirk et al. | 83/518 |
| 1,653,563 | A | * | 12/1927 | Gundlach | 83/518 |
| 2,266,629 | A | * | 12/1941 | Flynn | 83/614 |
| 2,789,642 | A | * | 4/1957 | Schwork | 83/518 |
| 3,735,445 | A | * | 5/1973 | Jurcak | 83/607 |
| 3,817,137 | A | * | 6/1974 | Thatcher | 83/518 |
| 4,589,313 | A | | 5/1986 | Meyers et al. | |
| 4,635,811 | A | * | 1/1987 | Lodi | 220/629 |
| 4,639,987 | A | * | 2/1987 | Georgopoulos | 29/24.5 |
| 4,754,676 | A | * | 7/1988 | Wessels | 83/605 |
| 4,776,096 | A | | 10/1988 | Chang | |
| 4,807,363 | A | | 2/1989 | Clifton, Jr. | |
| 5,024,414 | A | * | 6/1991 | Drain | 248/688 |
| 5,037,253 | A | | 8/1991 | Molaro et al. | |
| 5,103,702 | A | * | 4/1992 | Yannazzone | 83/468.94 |
| 5,170,689 | A | * | 12/1992 | Dvorak | 83/518 |
| 5,332,209 | A | * | 7/1994 | Romansky et al. | 271/253 |
| 5,799,557 | A | * | 9/1998 | Wang | 29/24.5 |
| 5,806,394 | A | | 9/1998 | Marocco | |
| D409,651 | S | | 5/1999 | Rellinger | |
| 5,927,172 | A | * | 7/1999 | Wang | 82/639.1 |
| 6,003,217 | A | * | 12/1999 | Graves et al. | 83/929 |
| 6,079,306 | A | * | 6/2000 | Liu | 83/522.19 |
| 6,196,099 | B1 | * | 3/2001 | Marocco | 83/197 |
| 6,314,851 | B1 | * | 11/2001 | Graves et al. | 29/24.5 |
| 6,334,379 | B1 | * | 1/2002 | Sudano | 29/24.5 |
| 6,412,381 | B1 | * | 7/2002 | Wang et al. | 83/478 |
| 6,427,571 | B1 | * | 8/2002 | Hsu | 29/24.5 |
| 6,561,254 | B1 | * | 5/2003 | Liu | 160/178.1 R |

* cited by examiner

*Primary Examiner*—Allan N. Shoap
*Assistant Examiner*—Jason Prone

(57) ABSTRACT

A vertical blind cutting and hole-punching apparatus for repairing the slats of vertical blinds. The vertical blind cutting and hole-punching apparatus includes a slat support assembly including a board-like slat support member having a main wall with a bottom side and a generally flat top side and also with a first end and a second end and further with a round punch hole being disposed therethrough; and also includes a slat guide assembly including guide members being adjustably mounted upon the flat top side of the board-like slat support member; and further includes a cutter assembly being disposed at an end of the board-like slat support member; and also includes a hole-puncher assembly being mounted upon the board-like slat support member.

8 Claims, 4 Drawing Sheets

VERTICAL BLIND CUTTING AND HOLE-PUNCHING APPARATUS

BACKGROUND OF THE INVENTION

1. Field of the Invention

The present invention relates to a vertical blind cutter and hole-puncher and more particularly pertains to a new vertical blind cutting and hole-punching apparatus for repairing the slats of vertical blinds.

2. Description of the Prior Art

The use of a vertical blind cutter and hole-puncher is known in the prior art. More specifically, a vertical blind cutter and hole-puncher heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,807,363; U.S. Pat. No. 5,037,253; U.S. Pat. No. 5,806,394; U.S. Pat. No. 4,589,313; U.S. Pat. No. 4,776,096; and U.S. Pat. No. Des. 409,651.

While these devices fulfill their respective, particular objectives and requirements, the aforementioned patents do not disclose a new vertical blind cutting and hole-punching apparatus. The inventive device includes a slat support assembly including a board-like slat support member having a main wall with a bottom side and a generally flat top side and also with a first end and a second end and further with a round punch hole being disposed therethrough; and also includes a slat guide assembly including guide members being adjustably mounted upon the flat top side of the board-like slat support member; and further includes a cutter assembly being disposed at an end of the board-like slat support member; and also includes a hole-puncher assembly being mounted upon the board-like slat support member.

In these respects, the vertical blind cutting and hole-punching apparatus according to the present invention substantially departs from the conventional concepts and designs of the prior art, and in so doing provides an apparatus primarily developed for the purpose of repairing the slats of vertical blinds.

SUMMARY OF THE INVENTION

In view of the foregoing disadvantages inherent in the known types of vertical blind cutter and hole-puncher now present in the prior art, the present invention provides a new vertical blind cutting and hole-punching apparatus construction wherein the same can be utilized for repairing the slats of vertical blinds.

The general purpose of the present invention, which will be described subsequently in greater detail, is to provide a new vertical blind cutting and hole-punching apparatus which has many of the advantages of the vertical blind cutter and hole-puncher mentioned heretofore and many novel features that result in a new vertical blind cutting and hole-punching apparatus which is not anticipated, rendered obvious, suggested, or even implied by any of the prior art vertical blind cutter and hole-puncher, either alone or in any combination thereof.

To attain this, the present invention generally comprises a slat support assembly including a board-like slat support member having a main wall with a bottom side and a generally flat top side and also with a first end and a second end and further with a round punch hole being disposed therethrough; and also includes a slat guide assembly including guide members being adjustably mounted upon the flat top side of the board-like slat support member; and further includes a cutter assembly being disposed at an end of the board-like slat support member; and also includes a hole-puncher assembly being mounted upon the board-like slat support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vertical blind cutting and hole-punching apparatus which has many of the advantages of the vertical blind cutter and hole-puncher mentioned heretofore and many novel features that result in a new vertical blind cutting and hole-punching apparatus which is not anticipated, rendered obvious, suggested, or even implied by any of the prior art vertical blind cutter and hole-puncher, either alone or in any combination thereof.

It is another object of the present invention to provide a new vertical blind cutting and hole-punching apparatus which may be easily and efficiently manufactured and marketed.

It is a further object of the present invention to provide a new vertical blind cutting and hole-punching apparatus which is of a durable and reliable construction.

An even further object of the present invention is to provide a new vertical blind cutting and hole-punching apparatus which is susceptible of a low cost of manufacture with regard to both materials and labor, and which accordingly is then susceptible of low prices of sale to the consuming public, thereby making such vertical blind cutting and hole-punching apparatus economically available to the buying public.

Still yet another object of the present invention is to provide a new vertical blind cutting and hole-punching apparatus which provides in the apparatuses and methods of the prior art some of the advantages thereof, while simultaneously overcoming some of the disadvantages normally associated therewith.

Still another object of the present invention is to provide a new vertical blind cutting and hole-punching apparatus for repairing the slats of vertical blinds.

Yet another object of the present invention is to provide a new vertical blind cutting and hole-punching apparatus which includes a slat support assembly including a board-like slat support member having a main wall with a bottom side and a generally flat top side and also with a first end and a second end and further with a round punch hole being disposed therethrough; and also includes a slat guide assembly including guide members being adjustably mounted upon the flat top side of the board-like slat support member; and further includes a cutter assembly being disposed at an end of the board-like slat support member; and also includes a hole-puncher assembly being mounted upon the board-like slat support member.

Still yet another object of the present invention is to provide a new vertical blind cutting and hole-punching apparatus that eliminates the user having to measure before cutting and hole-punching the slats.

Even still another object of the present invention is to provide a new vertical blind cutting and hole-punching apparatus that is easy and convenient to set up and use to repair the slats of vertical blinds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
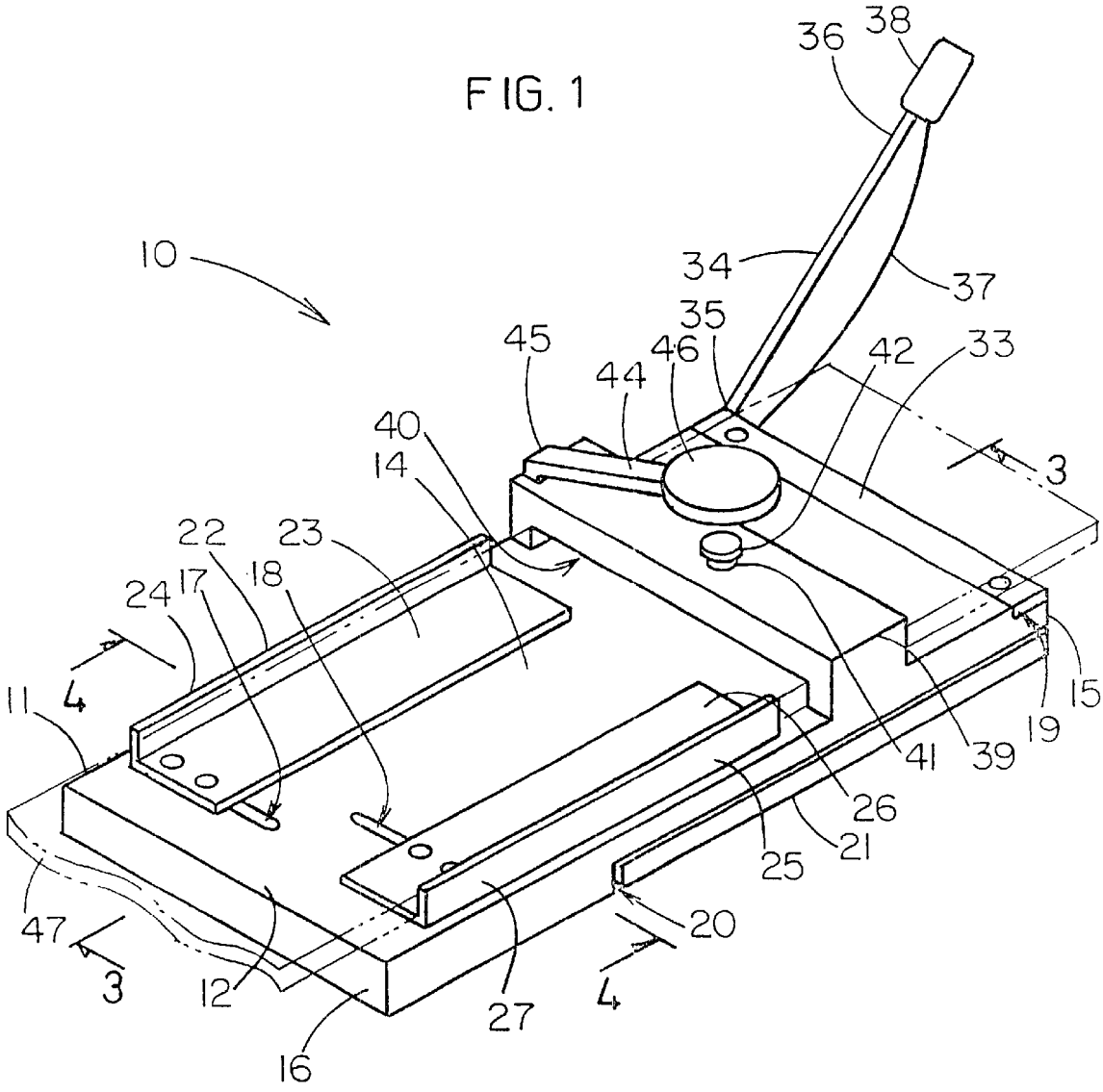
FIG. 1 is a top perspective view of a new vertical blind cutting and hole-punching apparatus according to the present invention.
Figure 2:
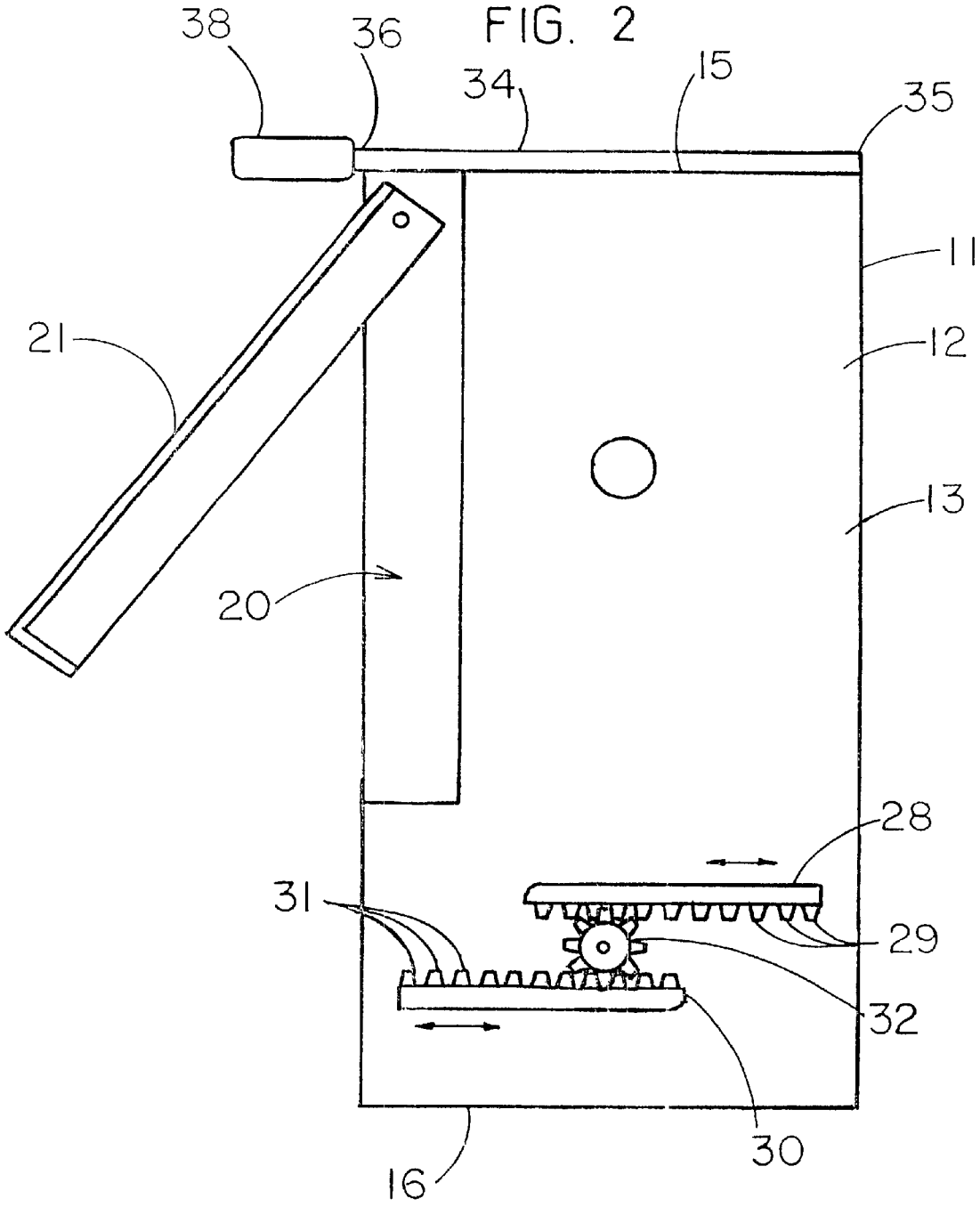
FIG. 2 is a bottom plan view of the present invention.
Figure 3:
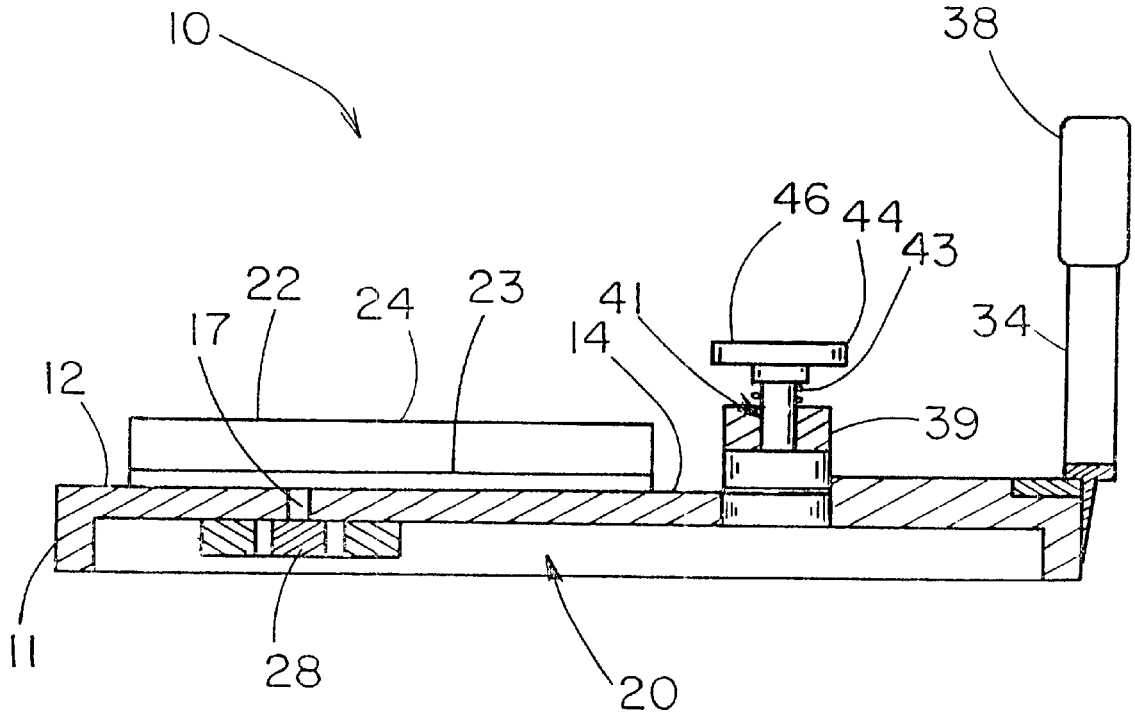
FIG. 3 is a longitudinal cross-sectional view of the present invention.
Figure 4:
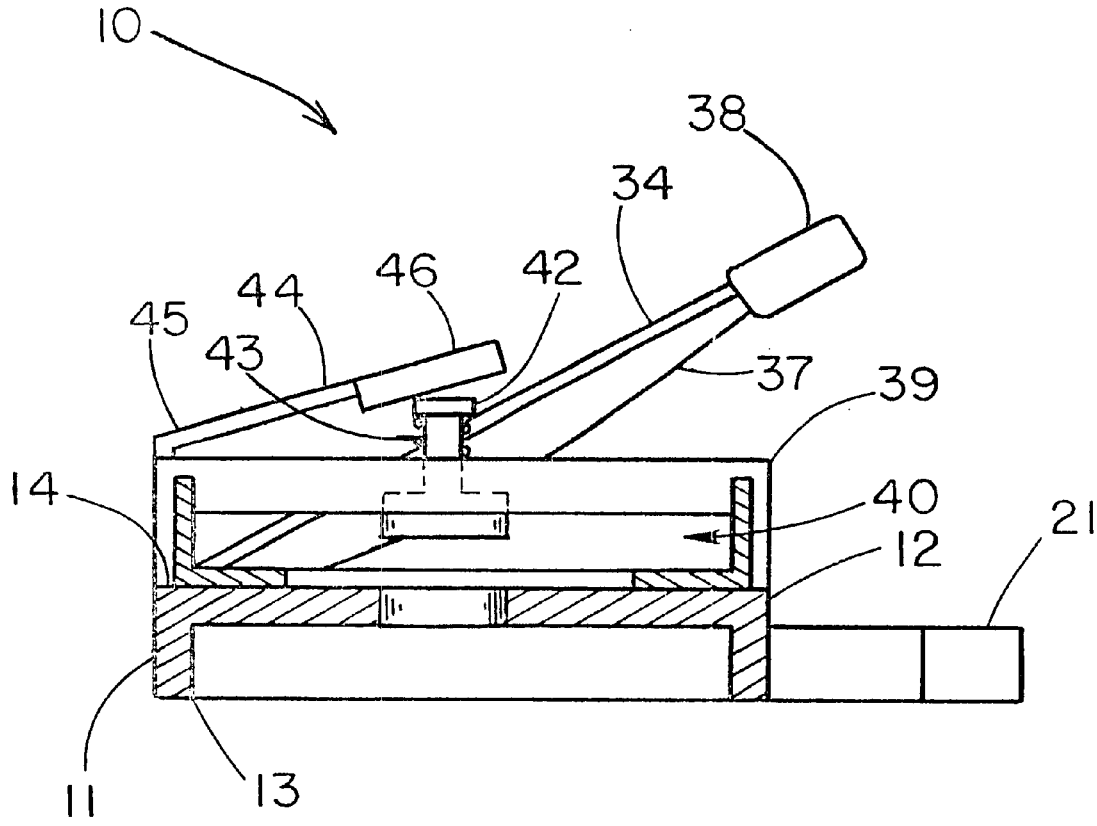
FIG. 4 is a lateral cross-sectional view of the present invention.

With reference now to the drawings, and in particular to FIGS. 1 through 4 thereof, a new vertical blind cutting and hole-punching apparatus embodying the principles and concepts of the present invention and generally designated by the reference numeral 10 will be described.

As best illustrated in FIGS. 1 through 4, the vertical blind cutting and hole-punching apparatus 10 generally comprises a slat support assembly including a board-like slat support member 11 having a main wall 12 with a bottom side 13 and a generally flat top side 14 and also with a first end 15 and a second end 16 and further with a round punch hole being disposed therethrough. The board-like slat support member 11 includes a pair of laterally-extended slots 17,18 being disposed through the main wall 12 near the second end 16 thereof. The laterally-extended slots 17,18 are longitudinally spaced apart and are disposed parallel to one another. The board-like slat support member 11 also includes a laterally-extended recessed portion 19 being disposed in the top side 14 of the main wall 12 at the first end 15 thereof. The board-like slat support member 11 further includes a longitudinally-extended recessed portion 20 being disposed in the bottom side 13 along a longitudinal side thereof. The slat support assembly further includes a stabilizer 21 having an end which is pivotally and conventionally attached to the board-like slat support member 11 and pivotally received in the longitudinally-extended recessed portion 20 of the bottom side 13 of the main wall 12. The stabilizer 21 is an arm which is pivotally and conventionally extendable from the board-like slat support member 11.

A slat guide assembly includes guide members 22,25 being adjustably mounted upon the flat top side 14 of the board-like slat support member 11. The slat guide assembly also includes a pair of elongate guide support members 28,30 each being securely and conventionally attached to a respective guide member 22,25 through a respective laterally-extended slot 17,18 and being movably disposed upon the bottom side 13 of the main wall 12. Each of the elongate guide support members 28,30 has a plurality of teeth 29,31 being disposed and spaced along a longitudinal side thereof. The slat guide assembly further includes a gear member 32 being rotatably and conventionally attached to the bottom side 13 of the main wall 12 between the pair of elongate guide support members 28,30 and being engaged to the teeth 29,31 of the elongate guide support members 28,30. Each of the guide members 22,25 includes a flat main portion 23,26 being movably disposed upon the top side 14 of the main wall 12, and also includes a longitudinal end portion 24,27 which is integrally attached to the flat main portion 23,26 and which is angled relative to the flat main portion 23,26. Each of the longitudinal end portions 24,27 is integrally attached along an outer longitudinal edge of a respective. flat main portion 23,26.

A cutter assembly is disposed at the first end 15 of the board-like slat support member 11. The cutter assembly includes a bar member 33 being securely and conventionally disposed in the laterally-extended recessed portion 19, and also includes an elongate blade support member 34 having a first end 35 which is pivotally and conventionally attached to the board-like slat support member 11 at the first end 15 thereof, and further includes a blade 37 being conventionally attached to and extending along a length of the elongate blade support member 34, and also includes a handle member 38 being securely and conventionally attached to a second end 36 of the elongate blade support member 34 with the blade 37 being engagable along a longitudinal edge of the bar member 33 for cutting slats 47.

A hole-puncher assembly is conventionally mounted upon the board-like slat support member 11. The hole-puncher assembly includes an elongate punch support member 39 being laterally extended upon the top side 14 of the main wall 12 of the board-like slat support member 11 and being spaced from the first end 15 thereof and having a longitudinal slot 40 being disposed in a side facing away from the first end 15 of the main wall 12 of the board-like slat support member 11 and also having a hole 41 extending therethrough into the longitudinal slot 40, and also includes a punch member 42 being securely and movably disposed in and through the hole 41 of the elongate punch support member 39 for making round holes, and further includes a spring member 43 being conventionally disposed about the punch member 42 for biasing the punch member 42 out of the longitudinal slot 40, and also includes a punch striker member 44 being pivotally and conventionally attached to the elongate punch support member 39 and having an arm 45 and a striker head 46 for striking the punch member 42.

In use, to cut the slat 47, the user places a slat 47 upon the top side 14 of the main wall 12 against the elongate punch support member 39 and uses the blade 37 to cut the particular slat 47 to the specifications desired. To punch a round hole in the slat 47, the user places the slat 47 upon the top side 14 of the main wall 12 between the guide members 22,25 and in the longitudinal slot 40 of the elongate punch support member 39, and presses upon the punch striker member 44 which strikes the punch member 42 to punch a round hole through the slat 47.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vertical blind cutting and hole-punching apparatus comprising:

a slat guide assembly including guide members being adjustably mounted upon said flat top side of said planar slat support member;

a cutter assembly being disposed at an end of said planar slat support member;

a hole-puncher assembly being mounted upon said planar slat support member;

wherein said planar slat support member further includes a longitudinally-extended recessed portion being disposed in said bottom side along a longitudinal side thereof; and wherein said slat support assembly further includes a stabilizer having an end which is pivotally attached to said planar slat support member and pivotally received in said longitudinally-extended recessed portion of said bottom side of said main wall, said stabilizer being an arm which is pivotally extendable from said planar slat support member.

2. A vertical blind cutting and hole-punching apparatus as described in claim 1, wherein said planar slat support member includes a pair of laterally-extended slots being disposed through said main wall near said second end thereof, said laterally-extended slots being longitudinally spaced apart and being disposed parallel to one another.

3. A vertical blind cutting and hole-punching apparatus as described in claim 2, wherein said planar slat support member also includes a laterally-extended recessed portion being disposed in said top side of said main wall at said first end thereof.

4. A vertical blind cutting and hole-punching apparatus as described in claim 2, wherein said slat guide assembly also includes a pair of elongate guide support members each being securely attached to a respective said guide member through a respective said laterally-extended slot and being movably disposed upon said bottom side of said main wall, each of said elongate guide support members having a plurality of teeth being disposed and spaced along a longitudinal side thereof, said slat guide assembly further including a gear member being rotatably attached to said bottom side of said main wall between said pair of elongate guide support members and being engaged to said teeth of said elongate guide support members.

5. A vertical blind cutting and hole-punching apparatus as described in claim 6, wherein each of said guide members includes a flat main portion being movably disposed upon said top side of said main wall, and also includes a longitudinal end portion which is integrally attached to said flat main portion and which is angled relative to said flat main portion, each of said longitudinal end portions being integrally attached along an outer longitudinal edge of a respective said flat main portion.

6. A vertical blind cutting and hole-punching apparatus as described in claim 3, wherein said cutter assembly includes a bar member being securely disposed in said laterally-extended recessed portion, and also includes an elongate blade support member having a first end which is pivotally attached to said planar slat support member at said first end thereof, and further includes a blade being attached to and extending alone a length of said elongate blade support member, and also includes a handle member being securely attached to a second end of said elongate blade support member, said blade being engagable along a longitudinal edge of said bar member for cutting slats.

7. A vertical blind cutting and hole-punching apparatus as described in claim 1, wherein said hole-puncher assembly includes an elongate punch support member being laterally extended upon said top side of said main wall of said planar slat support member and being spaced from said first end thereof and having a longitudinal slot being disposed in a side facing away from said first end of said main wall of said planar slat support member and also having a hole extending therethrough into said longitudinal slot, and also includes a punch member being securely and movably disposed in and through said hole of said elongate punch support member, and further includes a spring member being disposed about said punch member for biasing said punch member out of said longitudinal slot, and also includes a punch striker member being pivotally attached to said elongate punch support member and having an arm and a striker head for striking said punch member.

8. A vertical blind cutting and hole-punching apparatus comprising:

a slat support assembly including a planar slat support member having a main wall with a bottom side and a generally flat top side and also with a first end and a second end and longitudinal sides therebetween, and further with a round punch hole being disposed through said slat support assembly, said slat support member having a width between said first and second ends of said main wall, having a length between said longitudinal sides, and having a height between said top and bottom sides of said main wall, the height of said slat support member being less than the width and length of said slat support member through said main wall near said second end thereof, said laterally-extended slots being longitudinally spaced apart and being disposed parallel to one another, said planar slat support member also including a laterally-extended recessed portion being disposed in said top side of said main wall at said first end thereof, said planar slat support member further including a longitudinally-extended recessed portion being disposed in said bottom side along a longitudinal side thereof, said slat support assembly further including a stabilizer having an end which is pivotally attached to said planar slat support member and pivotally received in said longitudinally-extended recessed portion of said bottom side of said main wall, said stabilizer being an arm which is pivotally extendable from said planar slat support member;

a slat guide assembly including guide members being adjustably mounted upon said flat top side of said planar slat support member, said slat guide assembly also including a pair of elongate guide support members each being securely attached to a respective said guide member through a respective said laterally-extended slot and being movably disposed upon said bottom side of said main wall, each of said elongate guide support members having a plurality of teeth being disposed and spaced along a longitudinal side thereof, said slat guide assembly further including a gear member being rotatably attached to said bottom side of said main wall between said pair of elongate guide support members and being engaged to said teeth of said elongate guide support members, each of said guide members including a flat main portion being movably disposed upon said top side of said main wall, and also including a longitudinal end portion which is integrally attached to said flat main portion and which is angled relative to said flat main portion, each of said longitudinal end portions being integrally attached along an outer longitudinal edge of a respective said flat main portion;

a cutter assembly being disposed at an end of said planar slat support member, said cutter assembly including a bar member being securely disposed in said laterally-extended recessed portion, and also including an elongate blade support member having a first end which is pivotally attached to said planar slat support member at said first end thereof, and further including a blade being attached to and extending along a length of said elongate blade support member, and also including a handle member being securely attached to a second end of said elongate blade support member, said blade being engagable along a longitudinal edge of said bar member for cutting slats; and a hole-puncher assembly being mounted upon said planar slat support member, said hole-puncher assembly including an elongate punch support member being laterally extended upon said top side of said main wall of said planar slat support member and being spaced from said first end thereof and having a longitudinal slot being disposed in a side facing away from said first end of said main wall of said planar slat support member and also having a hole extending therethrough into said longitudinal slot, and also including a punch member being securely and movably disposed in and through said hole of said elongate punch support member for making a round holes in the slats, and further including a spring member being disposed about said punch member for biasing said punch member out of said longitudinal slot, and also including a punch striker member being pivotally attached to said elongate punch support member and having an arm and a striker head for striking said punch member.

* * * * *